US006899490B2

(12) United States Patent
Lee et al.

(10) Patent No.: US 6,899,490 B2
(45) Date of Patent: May 31, 2005

(54) CUT OFF AND STRIKE OFF MECHANISM FOR A PAVING MACHINE

(75) Inventors: William Michael Lee, Newton, NC (US); Eric Craig Lee, Maiden, NC (US)

(73) Assignee: B.R. Lee Industries, Inc., Denver, NC (US)

( * ) Notice: Subject to any disclaimer, the term of this patent is extended or adjusted under 35 U.S.C. 154(b) by 0 days.

(21) Appl. No.: 10/386,145

(22) Filed: Mar. 11, 2003

(65) Prior Publication Data

US 2004/0179895 A1 Sep. 16, 2004

(51) Int. Cl.[7] ..... E01C 19/22
(52) U.S. Cl. ..... 404/101
(58) Field of Search ..... 404/96, 101

(56) References Cited

U.S. PATENT DOCUMENTS 3,838,933 A * 10/1974 Lehman et al. ..... 404/114
4,379,653 A * 4/1983 Brown ..... 404/118
5,060,404 A * 10/1991 Lipford ..... 37/326
5,443,325 A * 8/1995 Simonelli et al. ..... 404/75
6,086,287 A 7/2000 Sharpe et al.
2003/0143024 A1 7/2003 Sharpe et al.

OTHER PUBLICATIONS

Photographs showing a cut off and strike off mechanism in a paving machine manufactured and sold by the assignee of the present application more than one year before the filing date of the present application.

* cited by examiner

*Primary Examiner*—Gary S. Hartmann
(74) *Attorney, Agent, or Firm*—Smith, Gambrell & Russell, LLP

(57) ABSTRACT

An auger/cut off assembly for a floating screed asphalt paver. The auger/cut off assembly consists of an auger mechanism with an axis of rotation and a cut off mechanism. The cut off mechanism has a concave cut off panel that rotates about the axis of the auger mechanism from an open strike off position to a closed cut off position. Because the concave cut off panel closely conforms to a portion of the circumference of the auger mechanism, the cut off mechanism provides for low ground clearance. The concave cut off panel serves the dual function of striking off the paving material when in the open strike off position and cutting off the deposit of paving material when in the closed cut off position.

8 Claims, 5 Drawing Sheets

CUT OFF AND STRIKE OFF MECHANISM FOR A PAVING MACHINE

FIELD OF THE INVENTION

This invention relates to a floating screed asphalt paver, and more particularly, relates to a floating screed paver having a floating screed and an auger/cut off assembly. The auger/cut off assembly includes an auger mechanism for distributing asphalt paving material evenly in front of the floating screed and a cut off mechanism for cutting off the flow of paving material to the floating screed when the cut off mechanism is in a closed cut off position and for striking off the paving material in front of the floating screed when the cut off mechanism is in an open strike off position.

BACKGROUND OF THE INVENTION

Most asphalt pavers employ a floating screed in which asphalt paving material is distributed in front of the floating screed as the paver moves along the roadbed to be paved. Particularly, such a conventional floating screed paver consists of a self-propelled power unit, a floating screed connected at the rear end of the power unit, a hopper at the forward end of the power unit for receiving paving material from a dump truck, a gravity feed hopper or a conveyor system for moving the paving material from the hopper to the roadbed in front of the floating screed, an auger assembly between the conveyor system and the floating screed for evenly distributing the paving material across the width of the floating screed, and a fixed strike off plate between the auger and the floating screed to control buildup of paving material in front of the floating screed.

The self-propelled power unit is typically mounted on tracks or rubber tires. The self-propelled power unit thereby provides the motive force for the paver along the roadbed as well as power for the operation and control of the various paving functions of the paver including functions associated with the hopper, the conveyor system, the auger, and the floating screed.

The hopper, mounted at the front end of the power unit, contacts the dump truck, and the power unit of the paver pushes the dump truck along the roadbed as the dump truck progressively dumps its load of paving material into the hopper.

The conveyor system on the paver or gravity moves the paving material from the hopper for discharge onto the roadbed. The screw auger spreads the paving material in front of and across the width of the floating screed. The fixed strike off plate controls the buildup of paving material in front of the floating screed.

The floating screed is commonly connected to the power unit by pivoting tow or draft arms, which allow the screed to float on the paving material. The depth of the paving material is controlled by a depth screw at each end of the screed. The screed functions to level, compact, and set the width of the paving material thereby leaving the finished asphalt slab with a uniform and smooth surface.

At the end of a paving pass with a conventional floating screed paver, the loose paving material that has been discharged by the conveyor system to the auger in front of the floating screed will remain on the roadbed and must be removed with a shovel by hand. In order to eliminate the labor involved in such a cleanup, prior art floating screed pavers have employed a cut off gate comprising a hinged cut off plate located in front of and below the auger. When the conventional cut off plate was activated by a hydraulic cylinder, the cut off plate would swing rearwardly into contact with the fixed strike off plate to eliminate the discharge of loose paving material onto the roadbed below the auger. The swinging cut off plate below the auger required additional ground clearance for its operation and thereby restricted how low the auger could be positioned.

In order for the auger to be lowered with minimum ground clearance, there is a need for a paving material cut off mechanism that does not require additional ground clearance. Moreover, there is a need for a cut off mechanism that is adjustable to varied the degree of strike off of paving material ahead of the floating screed and that can eliminate the deposit of loose paving material at the end of a paving pass.

In addition, there is a need for a auger/cut off assembly which may be divided into sections across the width of the paver. The auger sections can be independently operated, and the cut off mechanism sections can be independently opened and closed to control of the feed of paving material to the floating screed in discrete sections across the width of the floating screed.

SUMMARY OF THE INVENTION

The present invention satisfies the above-described need for an improved auger/cut off assembly by providing an auger/cut off assembly consisting of an auger mechanism and a cut off mechanism. The auger mechanism consists of a auger support member for supporting an auger for rotation about an axis. The cut off mechanism consists of at least one concave cut off panel that is rotated by means of an actuator about the axis of the auger between an open strike off position and a closed cut off position. Because the concave cut off panel closely conforms to a portion of the circumference of the auger, the auger/cut off assembly allows low ground clearance.

With the concave cut off panel in the open strike off position, the bottom of the auger is exposed so that the paving material can be discharged from the auger onto the roadbed. In addition, when the cut off panel is in the open strike off position, the leading edge of the concave cut off panel functions as a strike off edge. Moreover, because the cut off panel can be rotated between the open strike off position and the closed cut off position, the degree of engagement of the strike off edge can be continuously varied by the actuator to insure that the proper amount of paving material is removed by the strike off edge of the concave cut off panel.

In the closed cut off position, the concave cut off panel forms a trough beneath the auger to catch the loose paving material so that the loose paving material is not deposit on the roadbed at the end of a paving pass. Because the ends of the concave cut off panel are open, the loose paving material can be moved along the trough formed by the concave cut off panel and discharged through the open ends outboard of the floating screed paver for filling potholes or trenches for example.

Consequently, the concave cut off panel performs the dual function of striking off the paving material when the concave cut off panel is in the open strike off position and cutting off discharge of the paving material in front of the floating screed when the concave cut off panel is in the closed cut off position. In one embodiment of the invention, the auger/cut off assembly comprises a single auger mechanism and a single cut off mechanism. In another embodiment of the invention, the auger cut off assembly comprises a plurality of auger mechanisms and a plurality of cut off mechanisms. Particularly, in one embodiment, the concave cut off panel comprises two independently controlled concave cut off panels, and the auger comprises two independently controlled augers.

DETAILED DESCRIPTION OF THE PREFERRED EMBODIMENT

The present invention is an auger/cut off assembly for a floating screed paver. The auger/cut off assembly comprises an auger mechanism and a cut off mechanism. The auger mechanism consists of an auger support member attached to the floating screed paver which supports an auger for rotation about an axis. The cut off mechanism consists of at least one concave cut off panel that is rotated by means of an actuator about the axis of the auger between an open strike off position and a closed cut off position. In one embodiment, the auger mechanism consists of two independently controlled augers, and the cut off mechanism consists of two concave cut off panels that are independently rotated by means of independent actuators about the axis of the augers between an open strike off position and a closed cut off position.

Figure 1:
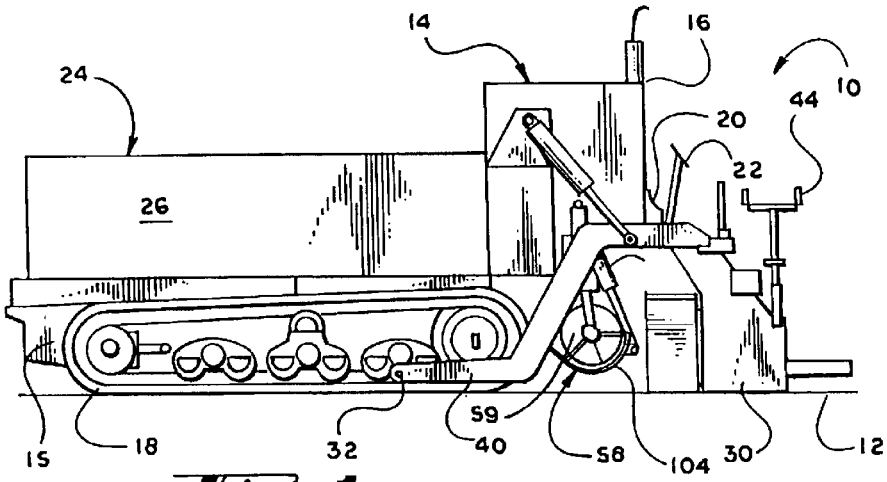
FIG. 1 is a side elevation view of a floating screed asphalt paver in accordance with the present invention.

Turning to the figures, FIG. 1 is a side elevation view of a floating screed asphalt paver 10 in accordance with the present invention. The floating screed paver 10 is designed to lay a finished slab of asphalt on a roadbed 12. In connection with the following description of the floating screed paver 10, references to "left" and "right" will be from the perspective of an operator at the rear of the paver 10 facing forward. Consequently, the elements shown in FIG. 1 are the left hand elements of the paver 10. By contrast in FIG. 7, the left side of the drawing represents the right hand side of the paver 10 and vice versa. With further reference to FIG. 1, the floating screed paver 10 comprises a self-propelled power unit 14, an operator deck 20, a hopper 24 with a left wing 26 and a right wing 28, a floating screed 30, an asphalt material conveyor system 52, and an auger/cut off assembly 58.

The self propelled power unit 14 includes a frame 15, a motor 16, generally a diesel engine, a hydraulic system (not shown), and crawler tracks 18. The motor 16 provides the prime motive power for the self propelled power unit 14. Typically, the motor 16 drives a hydraulic pump (not shown) which in turn drives hydraulic motors and cylinders to power the various functions of the floating screed paver 10. For example, a pair of hydraulic motors (not shown) propel the paver 10 along the roadbed 12 on the crawler tracks 18. In other embodiments of the paver 10, rubber tires may be used instead of the crawler tracks 18.

The floating screed paver 10 is controlled by an operator from the operator deck 20 by means of a control panel 22.

The hopper 24 receives asphalt paving material from a dump truck (not shown) at the front end of the paver 10. The wings 26 and 28 are controlled by means of hydraulic cylinders (not shown) to open in order to expand the width of the hopper 24 in order to receive paving material and to close in order to minimize the width of the hopper during transportation and maneuvering.

Figure 2:
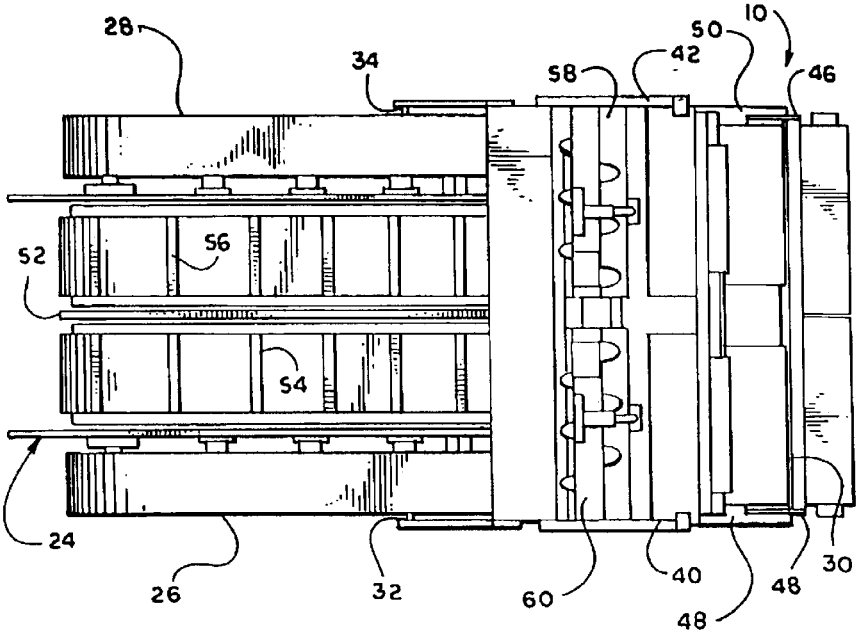
FIG. 2 is a top plan view of a floating screed asphalt paver in accordance with the present invention.

As shown in FIG. 2, the conveyor system 52 along the bottom of the hopper 24 delivers the paving material from the hopper 24 to the roadbed 12 in front of the floating screed 30. The conveyor system 52 is divided in half across the width of the hopper and consists of a left conveyor 54 and a right conveyor 56. Each conveyor 54 and 56 consists of the series of slats mounted at each end on a continuous chain. Each conveyor 54 and 56 is independently driven by a hydraulic motor to control the amount of paving material delivered to each half of the roadbed 12 in front of the floating screed 30. The conveyor system 52 could also consist of a single conveyor instead of the left conveyor 54 and the right conveyor 56. Alternatively, the conveyor system 52 could also consist of multiple conveyors extending across the width of the hopper 24. Moreover, the conveyor system 52 may comprise a gravity feed from the hopper.

The floating screed 30 is attached to the power unit 14 by means of a left draft arm 40, a right draft arm 42, a left pivot pin 32, and a right pivot pin 34 so that the floating screed 30 is pulled by the power unit 14 along the roadbed 12. The floating screed 30 is raised for transportation by means of hydraulic cylinders such as left side hydraulic cylinder 36. The floating screed 30 is supported on a left side skid 48 and on a right side skid 50 which contact the roadbed 12 when the paver 10 is not involved in a paving operation. During a paving operation, the relative height of the floating screed 30 with respect to the roadbed 12, and therefore the thickness of the finished slab, is controlled by a left side depth screw 44 and a right side depth screw 46. Particularly, the left side depth screw 44 and the right side depth screw 46 very the angle of attack of the floating screed 30 on each end of the floating screed 30.

In order to insure proper operation of the floating screed 30, the auger/cut off assembly 58 includes an auger mechanism 59 and a cut off mechanism 104. The auger mechanism 59 receives the paving material from the conveyor system 52 and distributes the paving material evenly across the width of the floating screed 30 including any screed extensions for producing wider paving widths. The cut off mechanism 104 has an open strike off position (FIGS. 3 and 5) and a closed cut off position (FIGS. 4 and 6). In the open strike off position, the cut off mechanism 104 strikes off the paving material in order to control buildup of the paving material in front of the floating screed 30. In the closed cut off position, the cut off mechanism cuts off the flow of paving material from the conveyor system 52 to the roadbed 12 in front of the floating screed 30 thereby eliminating the deposit of loose paving material on the roadbed 12 at the end of a paving pass.

Figure 3:
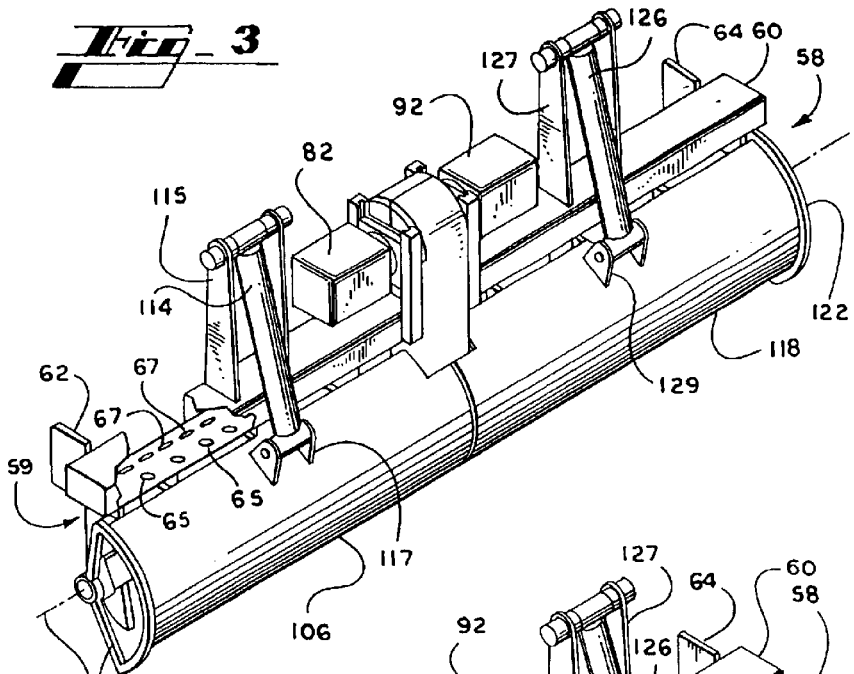
FIG. 3 is a rear perspective view of an auger/cut off assembly for a floating screed asphalt paver in accordance with the present invention with the cut off mechanism in an open strike off position.
Figure 4:
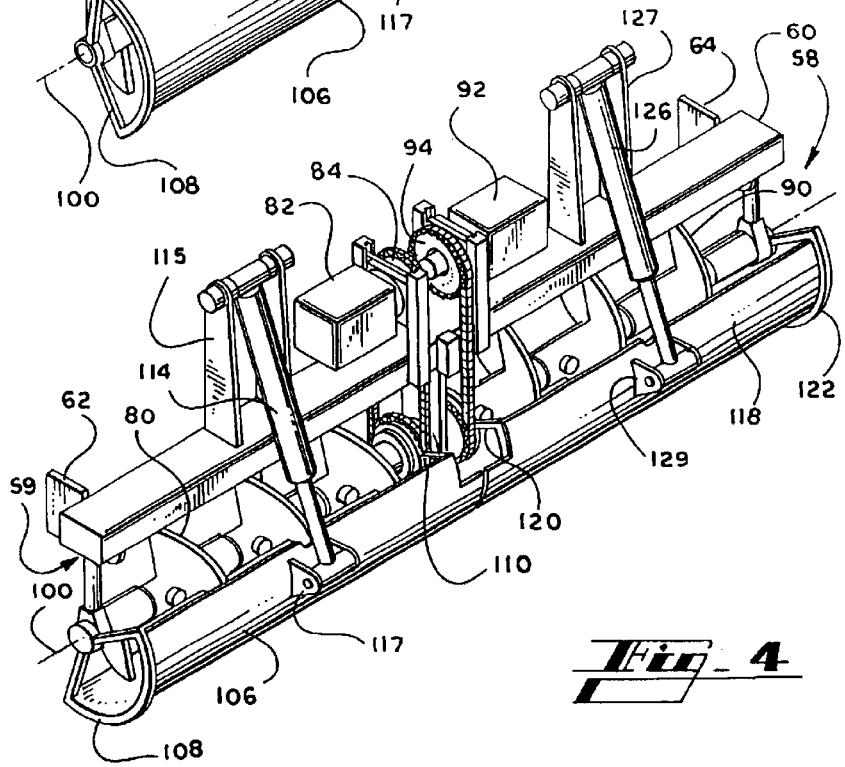
FIG. 4 is a rear perspective view of an auger/cut off assembly for a floating screed asphalt paver in accordance with the present invention with the cut off mechanism in a partially closed cut off position.
Figure 5:
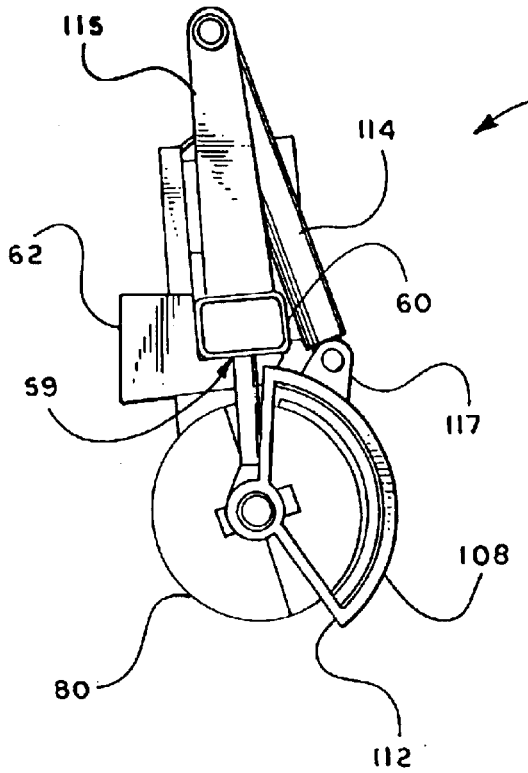
FIG. 5 is a side elevation view of an auger/cut off assembly for a floating screed asphalt paver in accordance with the present invention with the cut off mechanism in the open strike off position.
Figure 6:
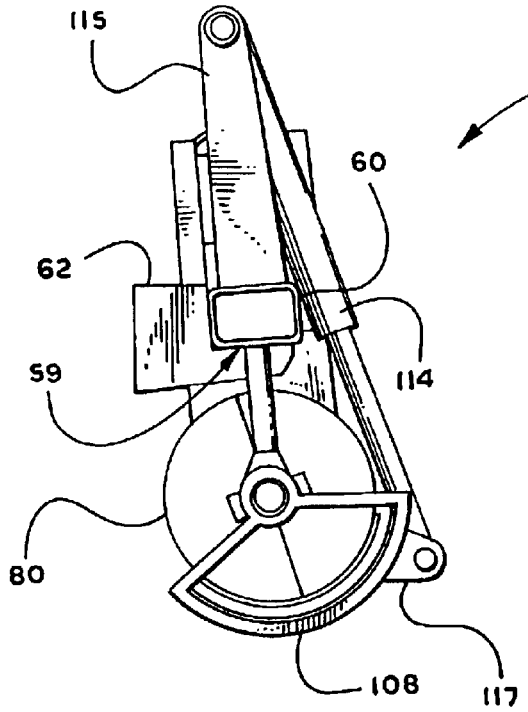
FIG. 6 is a side elevation view of an auger/cut off assembly for a floating screed asphalt paver in accordance with the present invention with the cut off mechanism in the closed cut off position.
Figure 7:
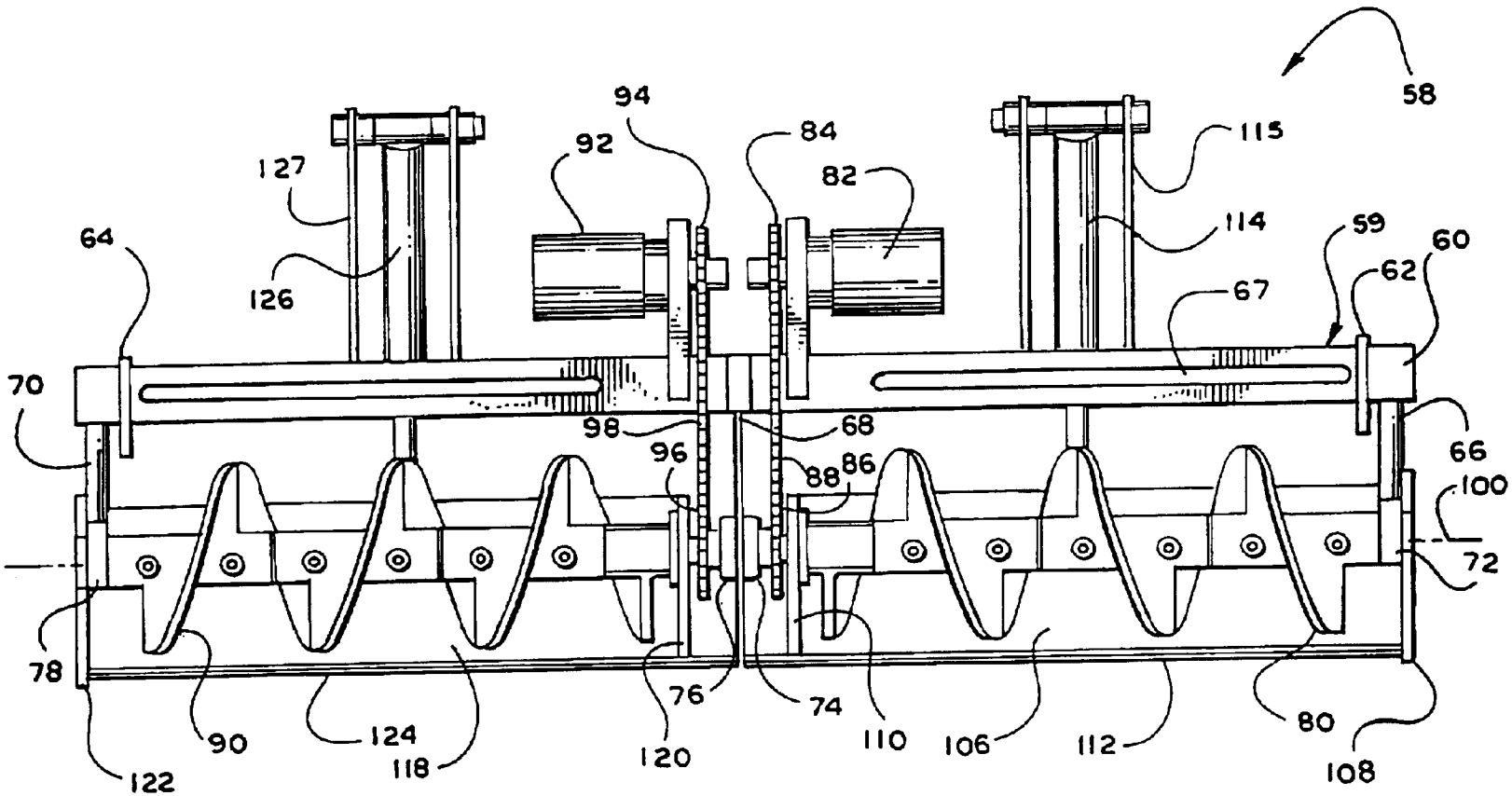
FIG. 7 is a front elevation view of an auger/cut off assembly for a floating screed asphalt paver in accordance with the present invention with the cut off mechanism in the partially closed cut off position.

Turning to FIGS. 3 and 5, the auger/cut off assembly 58 is shown in the open strike off position. As previously stated, the auger/cut off assembly 58 consists of the auger mechanism 59 and the cut off mechanism 104. With reference to FIG. 7, the auger mechanism 59 consists of an auger support member 60 and a left auger 80 and a right auger 90. The auger support member 60 has a left mounting bracket 62 and a right mounting bracket 64 for mounting the auger support member 60 to the self-propelled power unit 14 between the outlet of the conveyor system 52 and the floating screed 30. Auger bearing supports 66, 68, and 70 extended below the auger support member 60 and carry auger bearings 72, 74, 76, and 78. The left auger 80 is journaled for rotation in auger bearings 72 and 74, and the right auger 90 is journaled for rotation in auger bearings 76 and 78. The left auger 80 and the right auger 90 both rotate about a common auger axis of rotation 100. The left auger 80 is driven by a left hydraulic motor 82 by means of a left motor sprocket 84, a left auger sprocket 86, and a left drive chain 88. Likewise, the right auger 90 is driven by a right hydraulic motor 92 by means of a right motor sprocket 94, a right auger sprocket 96, and a right drive chain 98. Each of the hydraulic motors 82 and 92 are independently controllable in the forward or reverse direction by the operator from the controlled panel 22. Also, the speed of each of the hydraulic motors 82 and 92 is independently controlled by the operator from the control panel 22. Consequently, the augers 80 and 90 can be independently controlled to move paving material at different and variable rates from the center outward, from the sides inward, to the left, or to the right.

With reference to FIG. 3, the auger support member 60 is hollow with a series of inlet vents 65 along the length of the bottom of the support member 60 and outlets vents 67 along the front of the support member 60. A source of vacuum (not shown) is attached to outlets vents 67 in order to draw fumes from the paving material into inlet vents 67 and away from of paving material in close proximity with the operator of the paver. In that way, the fumes can be collected and processed before being released to the atmosphere away from the operator of the paver.

The cut off mechanism 104 of the auger/cut off assembly 58 consists of a left concave cut off panel 106 and a right concave cut off panel 118. As can best be seen in FIG. 4, the left concave cut off panel 106 has a partial hub 108 attached at one end and a partial hub 110 attached at the other end. Likewise, the left concave cut off panel 118 has a partial hub 120 attached at one end and a partial hub 122 attached at the other end. The partial hubs 108, 110, 120, and 122 are all journaled for rotation about the augers axis of rotation 100. The partial hubs 108 and 122 at the end of each of the concave cut off panels 106 and 118 are open. The concave cut off panels 106 and 118 have a circumference that closely matches of the circumference of the augers 80 and 90. In addition and as shown in FIG. 7, the left concave cut off panel 106 has a left strike off edge 112. Likewise, the right concave cut off panel 118 has a right strike off edge 124.

The rotation of the left cut off panel 106 about the axis of rotation 100 is independently controlled by a left actuator which includes a hydraulic cylinder 114 connected between a left upper bracket 115 and a left lower bracket 117. Likewise, the rotation of the right cut off panel 118 about the axis of rotation 100 is independently controlled by a right actuator which includes a hydraulic cylinder 126 connected between a right upper bracket 127 and a right lower bracket 129. The upper brackets 115 and 127 are fixed to the support member 60 and the lower brackets 117 and 129 are connected to the left concave cut off panel 106 and the right concave cut off panel 118 respectively.

FIGS. 3 and 5 illustrate the open strike off position of the cut off mechanism 59, and FIGS. 4 and 6 illustrate the closed cut off position of the cut off mechanism 59. During the continuous paving operation, the concave cut off panels 106 and 118 are rotated by means of the hydraulic cylinders 114 and 126 to the open strike off position shown in FIGS. 3 and 5. In the open strike off position, the strike off edges 112 and 124 of the concave cut off panels 106 and 118 strike off the paving material delivered from the conveyors 54 and 56 to the augers 80 and 90. The depth of engagement of the strike off edges 112 and 124 can be varied by extending and retracting the hydraulic cylinders 114 and 126 thereby allowing more or less paving material to reach the leading edge of the floating screed 30.

Once the paver reaches the end of paving run, the hydraulic cylinders 114 and 126 are extended so that the concave cut off panels 106 and 118 rotate to the fully closed cut off position shown in FIG. 6. If paving material remains in the augers 80 and 90 at the time the concave cut off panels 106 and 118 are move to the closed cut off position, the augers 80 and 90 may continue to run thereby delivering the paving material to the outside ends of the concave cut off panels 106 and 118. Because the partial end hubs 108 and 122 are open, the paving material is carried along the concave cut off panels 106 and 118 by the augers 80 and 90, and the paving material is thus expelled from the concave cut off panels 106 and 118 on either side of the paver 10. In that manner, loose paving material is not left on the roadbed 12 at the end of the finished slap at the end of the paving run. Any excess material is either carried in the concave cut off panels 106 and 118 or is extruded out of the ends of the cut off panels 106 and 118 to the side of the slab and out of the way. By extruded paving material out of the ends of the cut off panels 106 and 118, the paver can be used to deliver paving material to potholes or trenches along the side of the paver.

Because the concave cut off panels 106 and 118 are closely fit to the diameter of the augers 80 and 90 and because the concave cut off panels 106 and 118 rotate about the augers' axis of rotation 100, the concave cut off panels 106 and 118 extend below the augers 80 and 90 only by the thickness of the concave cut off panels 106 and 118 themselves. Consequently, the configuration of the concave cut off panels 106 and 118 and their rotation about the augers' axis of rotation 100 allows the augers 80 and 90 to be position close to the roadbed 12.

Figure 8:
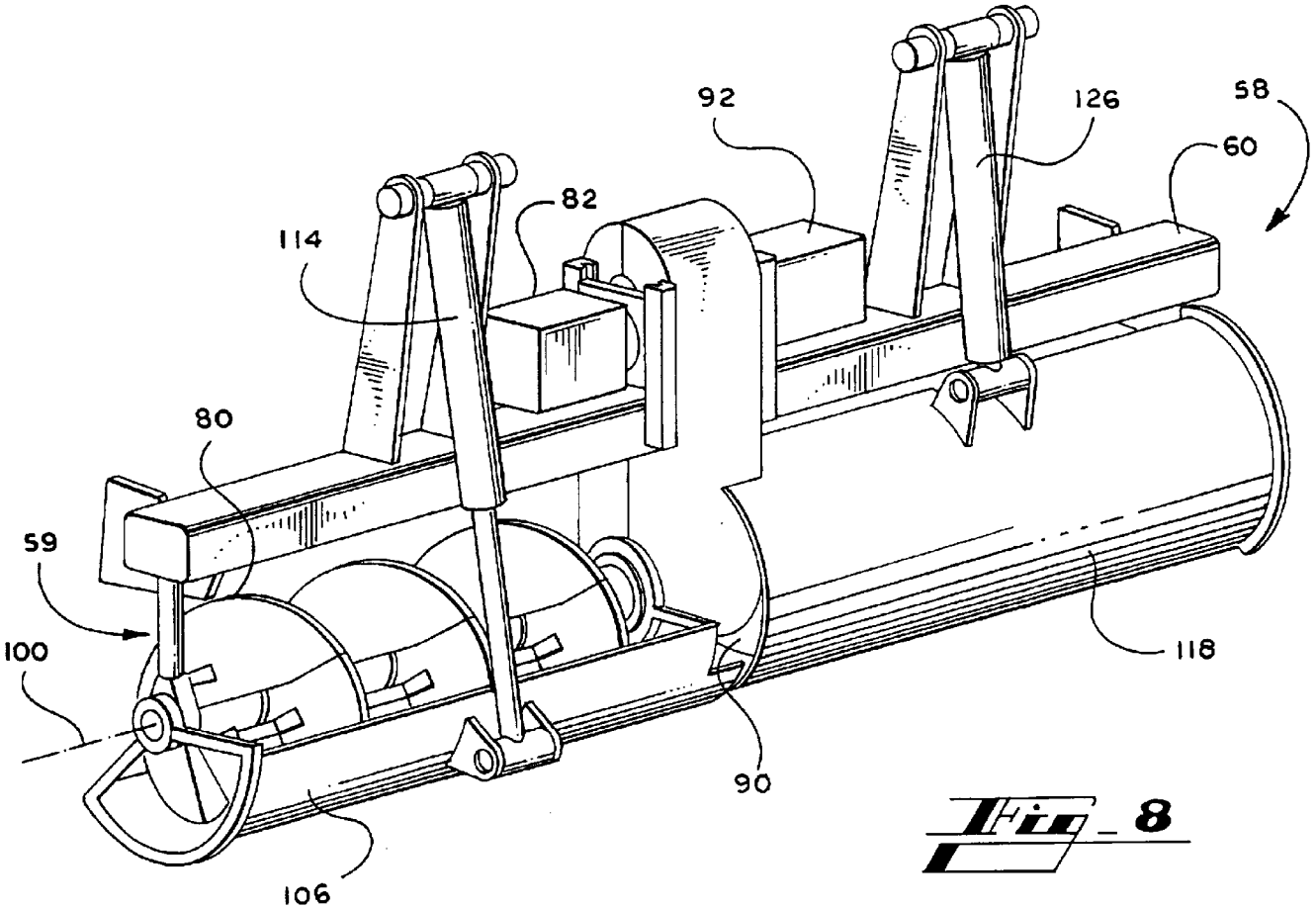
FIG. 8 is a rear perspective view of an auger/cut off assembly for a floating screed asphalt paver in accordance with the present invention with one section of the cut off mechanism in a closed cut off position and a second section of the cut off mechanism in the open strike off position.

FIG. 8 illustrates the auger/cut off assembly 58 with the left cut off panel 106 in the closed cut off position and the right cut off panel 118 in the open strike off position. With the cut off panels 106 and 118 independently position by the actuators 114 and 126 as shown in FIG. 8, the paver 10 can be used to pave a strip that is half the width of the paver.

The present invention thus contemplates an auger/cut off assembly with a single auger and single cut off panel, an auger/cut off assembly with two independently controlled augers (such as augers 80 and 90) and two independently controlled cut off panels (such as cut off panels 106 and 118), and an auger/cut off assembly with multiple independently controlled augers and multiple independently controlled cut off panels.

Alternative embodiments will become apparent to those skilled in the art to which the present invention pertains without departing from its spirit and scope. Accordingly, the scope of the present invention is defined by the appended claims rather than the foregoing description.

We claim:

1. In a floating screed paver with a floating screed and an auger mechanism, wherein the auger mechanism has an auger support member and an auger, which has an axis of rotation and which is rotatably supported by the auger support member, and wherein the auger mechanism is located forwardly of the screed, a cut off mechanism comprising:

a. a concave cut off panel mounted adjacent the auger and movable from an open position where the concave cut off panel is located rearwardly of the auger and forwardly of the screed to a closed position where the concave cut off panel is located beneath the auger to form a trough beneath the auger, and b. an actuator connected to the concave cut off panel for moving the concave panel from the open position to the closed cut off position.

2. The cut off mechanism of claim 1, wherein the auger has a circumference and the cut off panel is concaved to conform to a portion of the circumference of the auger.

3. The cut off mechanism of claim 1, wherein the concave cut off panel has open strike off ends so that when the concave cut off panel is in the closed cut off position, the concave cut off panel forms a trough beneath the auger for directing paving material outboard of the floating screed paver during continuing operation of the auger.

4. The cut off mechanism of claim 1, wherein the cut off panel comprises separately movable left and right cut off panels.

5. The cut off mechanism of claim 1, wherein the cut off panel is continuously adjustable between the open position and the closed cut off position to adjust the degree of strike off of material deposited by the auger.

6. The cut off mechanism of claim 1, wherein the auger support member is hollow with at least one fume vent port to conduct fumes away from the auger.

7. The cut off mechanism of claim 1, wherein the auger support member has at least one bracket for connecting the auger support member to the floating screed paver.

8. The cut off mechanism of claim 1, wherein the cut off panel rotates by means of the actuator about the axis of rotation of the auger from an open strike off position where the leading strike off edge engages and strikes off the paving material to a closed cut off position where the cut off panel contains the paving material.

* * * * *